US006173625B1

(12) United States Patent
McFarlane et al.

(10) Patent No.: US 6,173,625 B1
(45) Date of Patent: Jan. 16, 2001

(54) ADJUSTABLE MULTI-PEDAL ASSEMBLY

(75) Inventors: Jeffrey A. McFarlane; Michael James O'Neill, both of Harper Woods, MI (US)

(73) Assignee: Teleflex Incorporated, Plymouth Meeting, PA (US)

( * ) Notice: Under 35 U.S.C. 154(b), the term of this patent shall be extended for 0 days.

(21) Appl. No.: 09/461,466

(22) Filed: Dec. 14, 1999

(51) Int. Cl.[7] ..... G05G 1/14
(52) U.S. Cl. ..... 74/512
(58) Field of Search ..... 74/512, 513, 514, 74/560

(56) References Cited

U.S. PATENT DOCUMENTS

| | | | |
|---|---|---|---|
| 3,319,487 | 5/1967 | Lystad et al. . | |
| 3,511,109 | 5/1970 | Tanaka . | |
| 3,563,111 | 2/1971 | Zeigler . | |
| 3,643,524 | 2/1972 | Herring . | |
| 3,643,525 | 2/1972 | Gibas . | |
| 3,691,868 | 9/1972 | Smith . | |
| 3,828,625 * | 8/1974 | Bruhn, Jr. | 74/512 |
| 4,683,977 | 8/1987 | Salmon . | |
| 4,870,871 | 10/1989 | Ivan . | |
| 5,172,606 * | 12/1992 | Dzioba et al. | 74/513 X |
| 5,460,061 | 10/1995 | Redding et al. | 74/512 |
| 5,855,143 | 1/1999 | Ewing | 74/512 |

* cited by examiner

*Primary Examiner*—Mary Ann Green
(74) *Attorney, Agent, or Firm*—Howard & Howard

(57) ABSTRACT

The position of the pad end (18 and 118) of the first pedal lever (14 and 118) may be adjusted by pivoting an adjustment link (22 and 122) relative to a support bracket (12 and 112) as a drag link (26 and 126) pivots relative to an actuator link (28 and 128). Simultaneously with this adjustment of the operational axis of the first pedal lever (14 and 114), a control link (40 and 140) adjusts the position of the operational axis (40 and 140) of a second pedal lever (32 and 132) as a guide (38 and 138), in form of a link supported by the bracket (12 and 112) guides movement of the operational axis (40 and 140) of the second pedal lever (32 and 132) during the adjustment thereof. Otherwise, the normal operation of the respective pedal levers (14 and 114, 32 and 132) is independent of one another about their respective operational axes (29 and 129, 40 and 140).

11 Claims, 6 Drawing Sheets

ADJUSTABLE MULTI-PEDAL ASSEMBLY

BACKGROUND OF THE INVENTION

1. Field of the Invention

The subject invention relates to an adjustable pedal assembly of the type attached to an automotive vehicle to control the brake, clutch and/or throttle in normal operation but which can be adjusted to a different position to accommodate a different driver position.

2. Description of the Prior Art

An adjustable pedal assembly of the type to which this invention relates typically comprises a mounting bracket for attachment to a vehicle structure for supporting a first pedal lever having an upper end and a lower pad end. A linkage mechanism supports the pedal lever for operative pivotal movement relative to the bracket in a normal operational position to move a connection for a motion transmitting element but also allows the adjustment of the operational position of the pad end relative to the bracket while limiting movement of the element connection relative to the bracket during the adjustment. In other words, the fore and aft position of the pad end of the pedal lever may be adjusted by the supporting linkage mechanism but the motion transmitting element extending to the clutch, brake or throttle must not move during this adjustment. Examples of such linkage mechanisms are disclosed in U.S. Pat. No. 5,855,143 to Ewing. However, in accordance with the teachings in this patent there is suggestion, other than rudimentary engineering duplication, of adjusting a plurality of pedal levers, particularly pedal levers separated from one another like the separation between the accelerator pedal lever and the brake pedal lever. A multi-pedal lever assembly is disclosed in co-pending U.S. application Ser. No. 09/174,748, filed Oct. 19, 1999, which is assigned to the assignee of the subject invention. However, this assembly does not accommodate the separation between pedal levers while remaining efficient in design. More specifically, that prior art assembly requires the operational axes of the multiple pedal levers to be coaxial.

SUMMARY OF THE INVENTION AND ADVANTAGES

A novel adjustable pedal assembly of the type comprising a mounting bracket for attachment to a vehicle structure, a first pedal lever having an upper end and a lower pad end, and a motion transmitting element connection for attachment to and moving a motion transmitting element. A linkage mechanism supports the pedal lever for operative pivotal movement relative to the bracket in an operational position and supports the element connection for movement during the operative pivotal movement and for adjustment of the operational position of the pad end relative to the bracket while limiting movement of the element connection relative to the bracket during the adjustment. A second pedal lever has upper and lower ends and is rotatable about an operational axis. The assembly is characterized by a control link connecting the second pedal lever to the linkage mechanism for adjusting the operational position of the operational axis of the second pedal lever in response to the adjustment of the operational position of the pad end of the first pedal lever relative to the bracket, and a guide supported by the bracket for guiding movement of the operational axis of the second pedal lever during the adjustment thereof.

The subject invention provides a novel adjustable pedal assembly including a plurality of pedal levers which may be adjusted between operative positions in unison without changing or moving the controls to which they are attached but which will operate independently to move the controls during normal operation. The assembly will accommodate the separation between the accelerator and the brake pedal lever yet minimizes the components with an efficient design concept. The subject invention provides a novel adjustable pedal assembly including a plurality of pedal levers which are operable about independent operational axes and wherein the operational axis of the second pedal lever may be adjusted between operative positions in unison with the first pedal lever under the control of a guide.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 5:
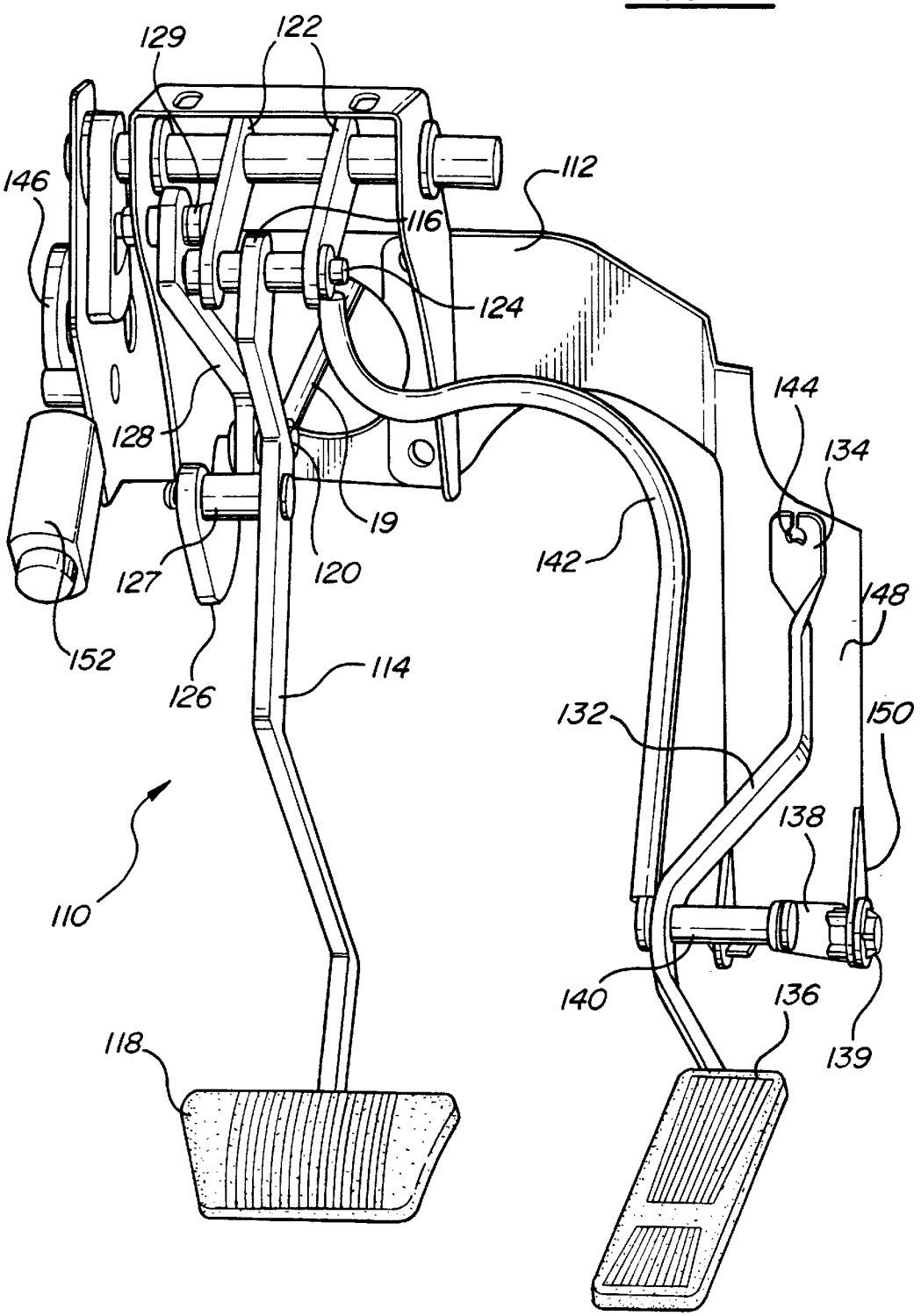
FIG. 5 is a perspective view of a second embodiment of the subject invention.
Figure 6:
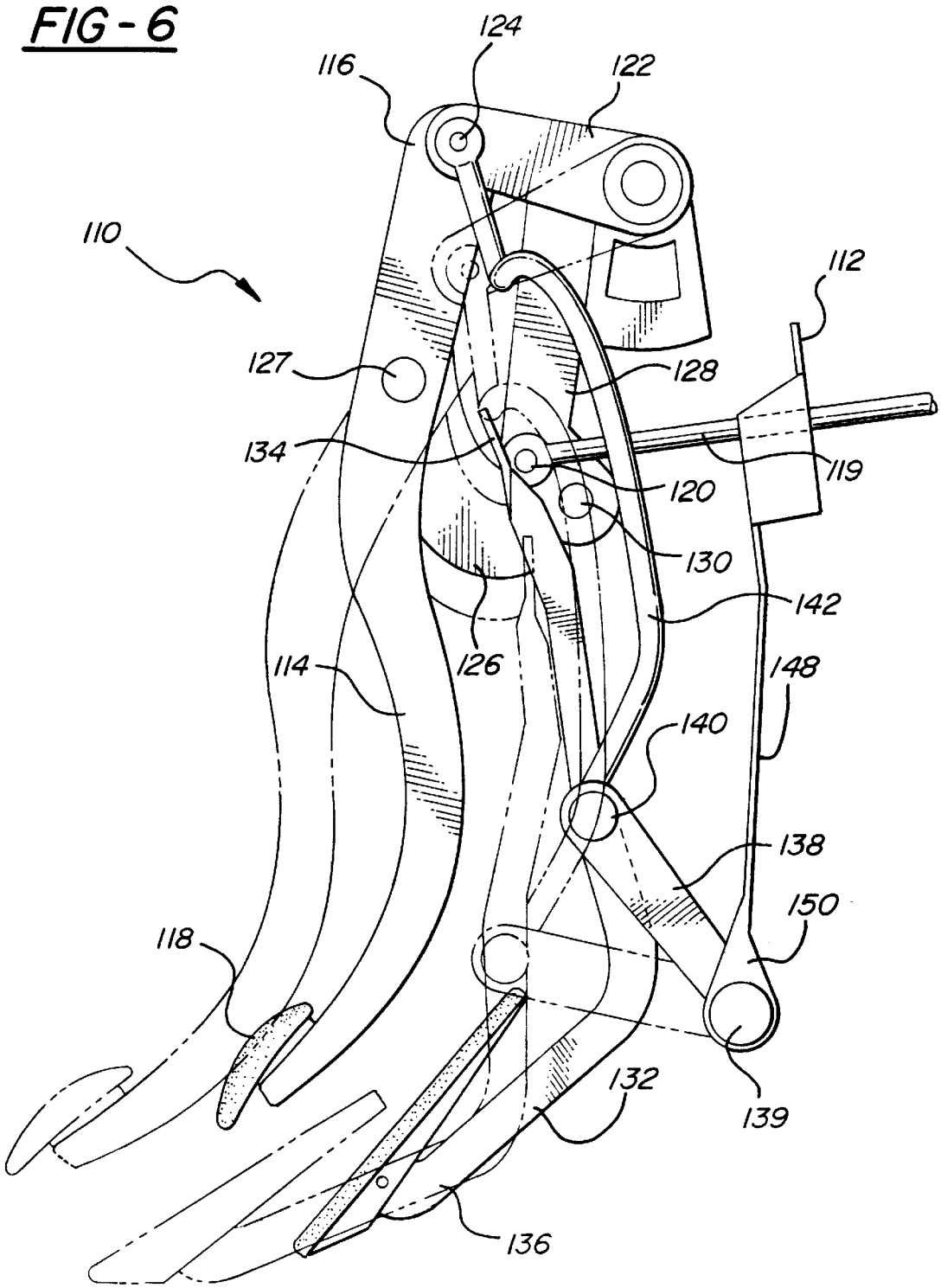
FIG. 6 is a schematic view taken from the right side of FIG. 5.
Figure 7:
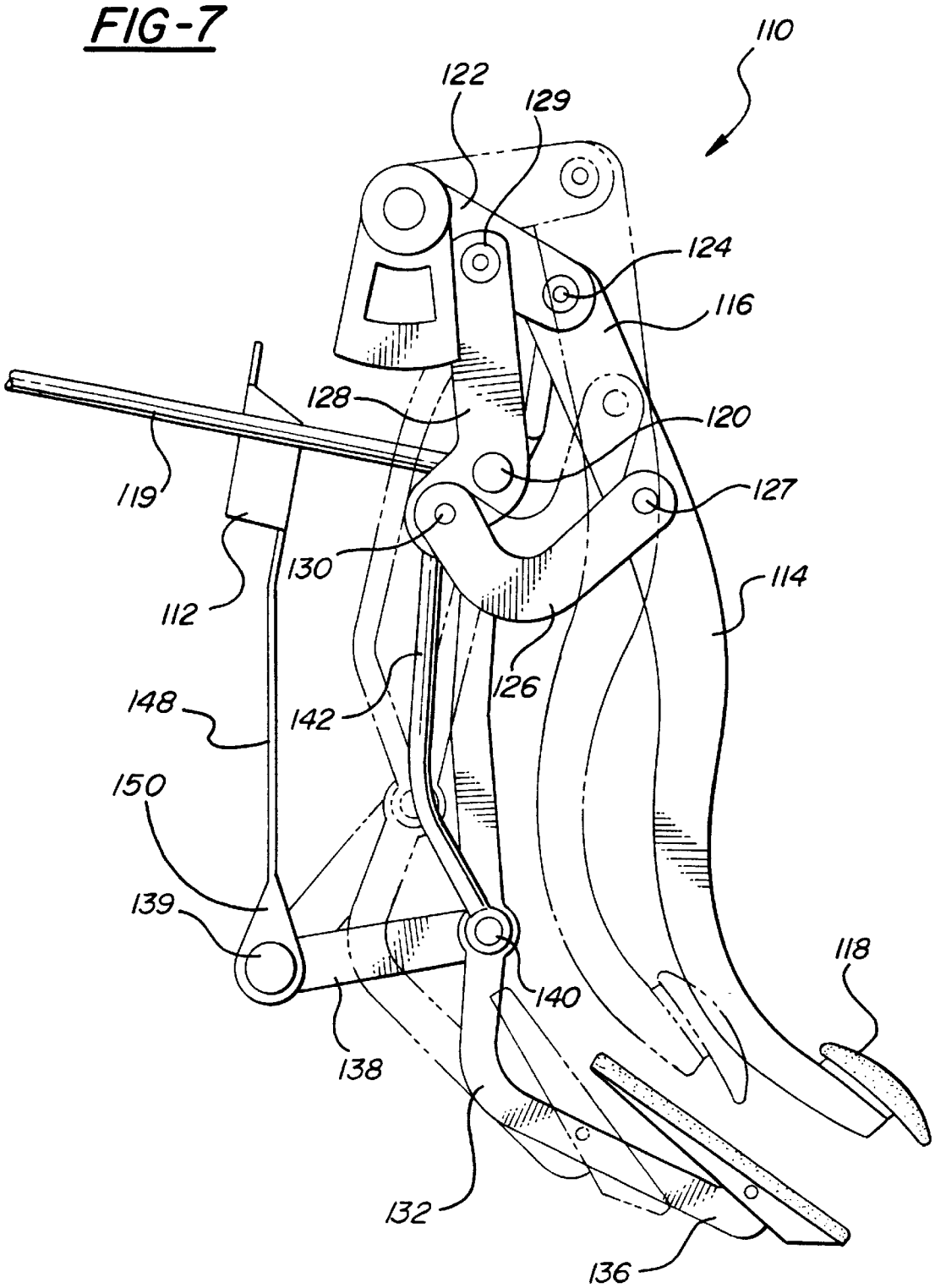
FIG. 7 is a schematic view taken from the left side of FIG. 5.

Referring to the Figures, wherein like numerals indicate like or corresponding parts throughout the several views, two embodiments of an adjustable pedal assembly are shown, one generally at 10 in FIGS. 1 through 4 and the second generally at 110 in FIGS. 5 through 7. Like or corresponding components or parts are indicated with like numerals differing by 100.

Each assembly 10 and 110 includes a mounting bracket 12 and 112 for attachment to a vehicle structure 13. The occupant seat 15 may be stationary relative to the vehicle structure 13 and the subject invention allows the pedal assemblies 10 and 110 to adjust the operating position of the pedals relative to the seat, i.e., the pedal assemblies 10 and 110 are adjusted in and out, i.e., forward and rearward, to adjust for occupants with different leg lengths or seating positions. In other words, instead of adjusting the position of the seat, the position of the pedals is adjusted.

Each assembly 10 and 110 includes a first pedal lever 14 and 114 having an upper end 16 and 116 and a lower pad end 18 and 118. A linkage mechanism supports the pedal lever 14 and 114 for operative pivotal movement relative to the bracket 12 and 112 in an operational position and supports an element connection 20 and 120 for movement during the operative pivotal movement and for adjustment of the operational position of the pad end 18 and 118 relative to the bracket 12 and 112 (between full lines and phantom lines) while limiting movement of the element connection 20 and 120 relative to the bracket 12 and 112 during the adjustment. The motion transmitting element connection 20 and 120 attaches to and moves a motion transmitting element, like a cable or rod 19 and 119, which is usually supplied by the automobile manufacturer and attaches to one of the clutch, brake or throttle control of a vehicle.

More specifically, the linkage mechanism includes an adjustment link 22 and 122 pivotally supported by the bracket 12 and 112 at one end thereof and extending to a distal end. The upper end 16 and 116 of the first pedal lever 14 and 114 is pivotally attached at a first pivot joint or axis 24 and 124 to the distal end of the adjustment link 22 and 122. A drag link 26 and 126 is pivotally connected to the first pedal lever 14 and 114 at a pivot joint or axis 27 and 127 for moving the element connection 20 and 120 during the operative pivotal movement of the first pedal lever 14 and 114. An actuator link 28 and 128 is pivotally attached at a pivot joint or axis 29 and 129 to the bracket 12 and 112 and extends to a stabilizing or lower end. The drag link 26 and 126 is pivotally connected at a first end via a pivot joint or axis 30 and 130 to the actuator link 28 and 128, the pivot joint or axis 30 in the first embodiment coinciding with the element connection 20. In any case, the element connection 20 and 120 is disposed on the actuator link 28 and 128.

The assembly 10 and 110 includes a second pedal lever 32 and 132 having upper 34 and 134 and lower 36 and 136 ends.

The assembly 10 and 110 is characterized by a control link 42 and 142 connecting the second pedal lever 32 and 132 to the linkage mechanism for adjusting the operational position of the operational axis 40 and 140 of the second pedal lever 32 and 132 in response to the adjustment of the operational position of the pad end 18 and 118 of the first pedal lever 14 and 114 relative to the bracket 12 and 112, and a guide 38 and 138 supported by the bracket 12 and 112 for guiding movement of the operational axis 40 and 140 of the second pedal lever 32 and 132 during the adjustment thereof. More specifically, the guide 38 and 138 comprises a guide link pivotally connected to the bracket 12 and 112 for pivotal movement about a pivot joint or an adjustment axis 39 and 139 and pivotally supports the second pedal lever 32 and 132 for pivotal movement about an operational axis 40 and 140.

The control link 42 and 142 and the upper end 16 and 116 of the first pedal lever 14 and 114 are pivotally attached to the distal end of the adjustment link 22 and 122. In the embodiment of FIGS. 1–4, the control link 42 and the upper end 16 of the first pedal lever 14 are pivotally attached to the distal end of the adjustment link 22 on different axes, 24 and 43, respectively, the axis 43 being defined by a pin extending laterally through a slot 47 in a flange of the bracket 12. In the embodiment of FIGS. 5–7, the control link 142 and the upper end 116 of the first pedal lever 114 are operatively or pivotally interconnected to the distal end of the adjustment link 122 on a common axis 124, e.g., by a common pin. It will be appreciated that the control link 42 and 142 may be operatively interrelated or interconnected with the movement of adjustment link 22 and 122 by various mechanisms so long as they move in unison.

Figure 1:
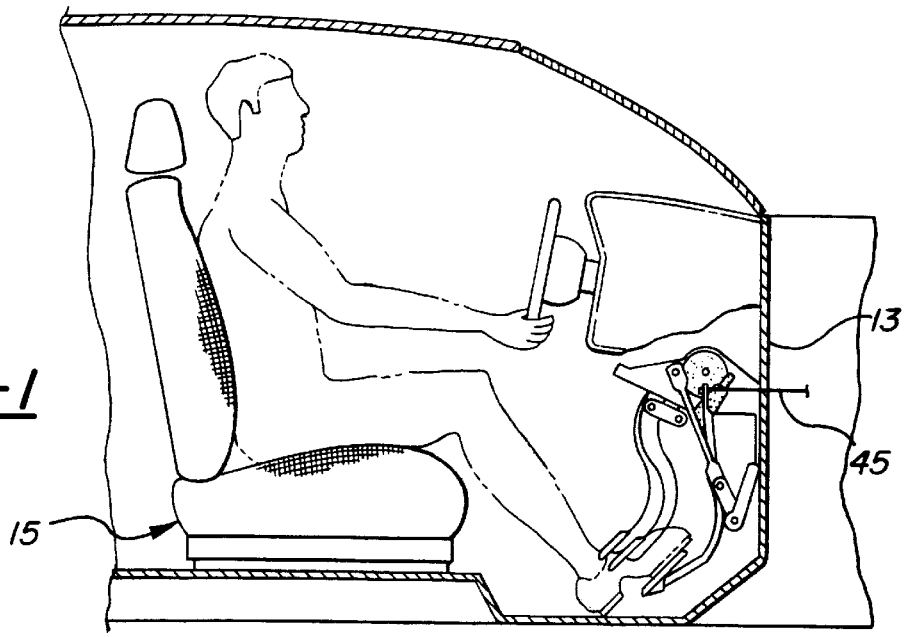
FIG. 1 is a fragmentary view of the subject invention installed in an automotive vehicle.
Figure 3:
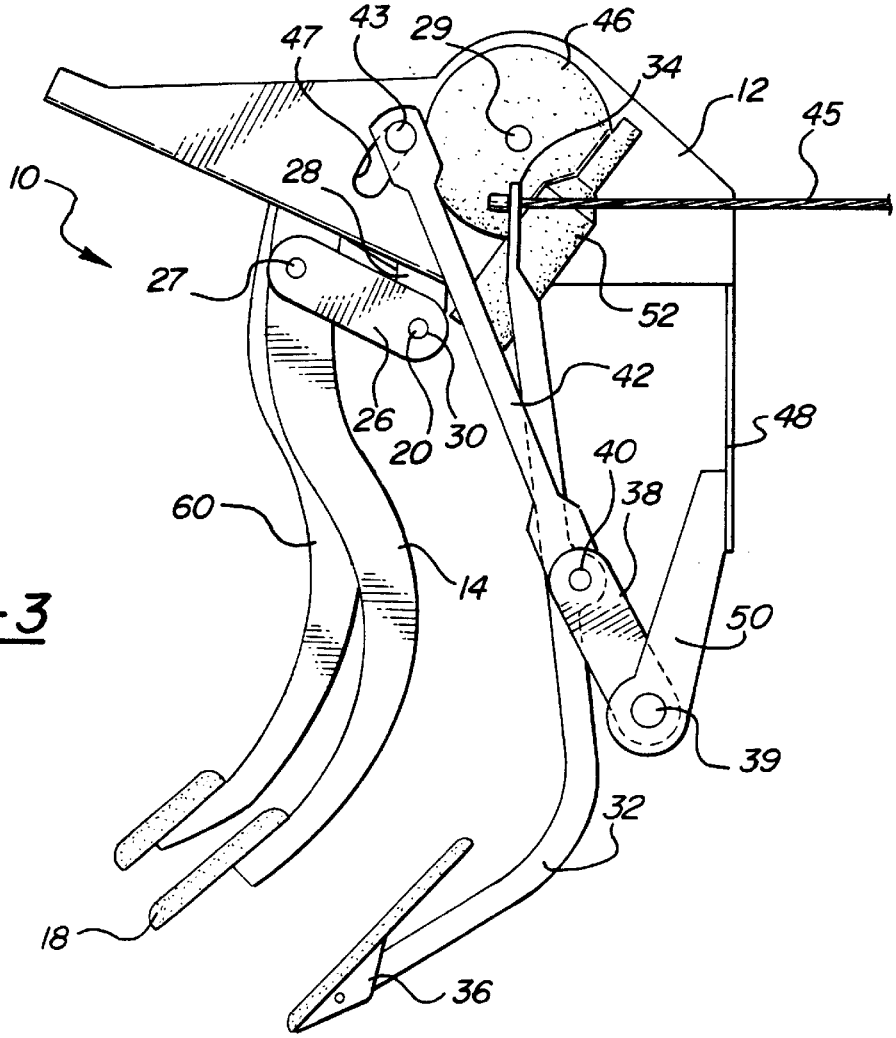
FIG. 3 is a side elevational view of the embodiment of FIG. 1 in a first position of adjustment.
Figure 2:
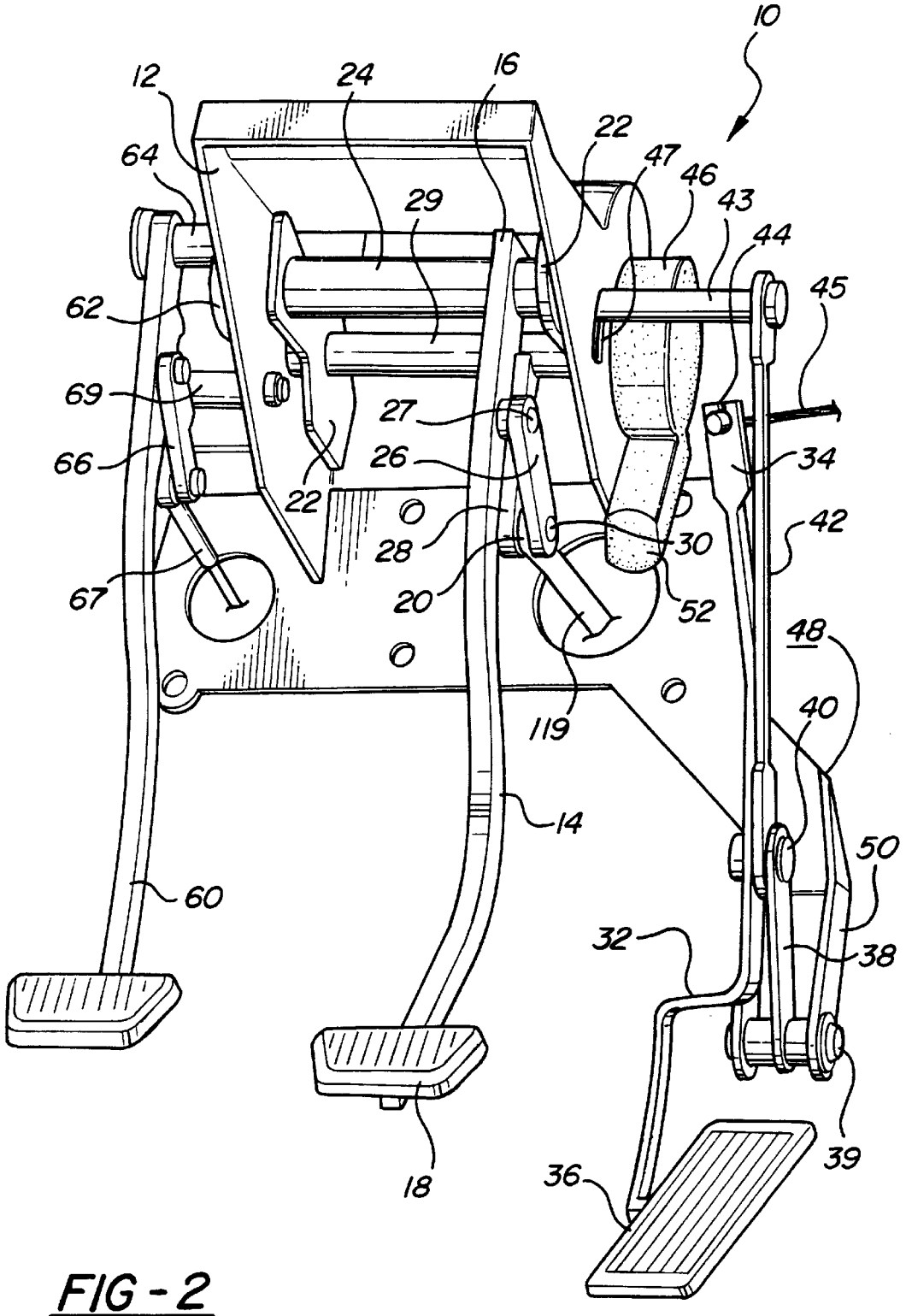
FIG. 2 is a perspective view of a first embodiment of the subject invention.
Figure 4:
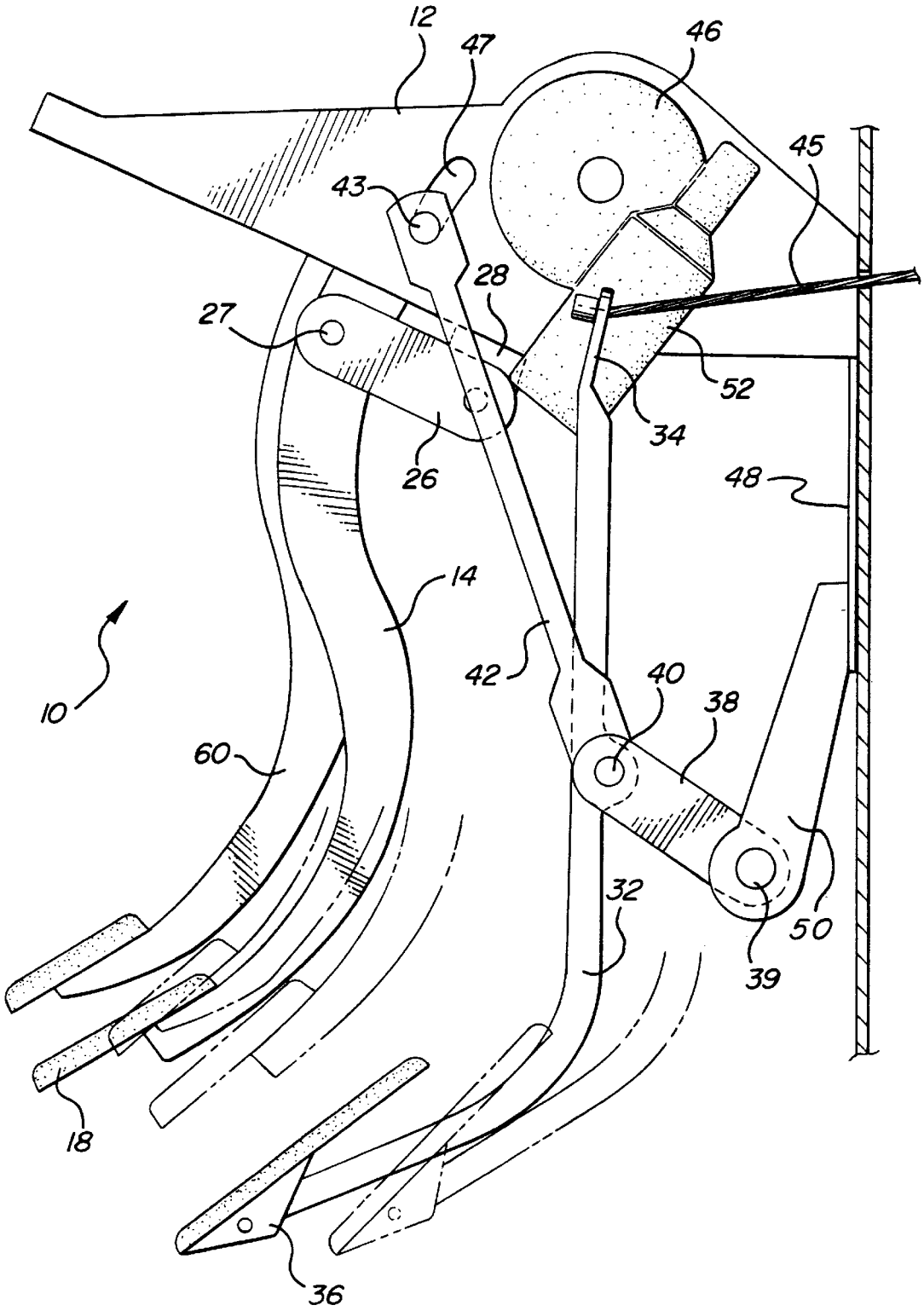
FIG. 4 is a side elevational view of the embodiment of FIG. 1 in a second position of adjustment.

The upper end 34 and 134 of the second pedal lever 32 and 132 extends above the operational axis 40 and 140 and the lower end 36 and 136 of the second pedal lever 32 and 132 extends below the operational axis 40 and 140. The upper end 34 and 134 of the second pedal lever 32 and 132 includes a vehicle system connection comprising a slot 44 and 144 (as shown in FIGS. 2 and 5) which remains substantially stationary or experiences limited movement during the adjustment. A cable 45 may be connected to the vehicle system connection 44 and 144. A pedal pad is attached to the lower end 36 and 136 of the second pedal lever 32 and 132

In operation, the position of the pad end 18 and 118 of the first pedal lever 14 and 114 may be adjusted by pivoting the adjustment link 22 and 122 relative to the bracket 12 and 112 as the drag link 26 and 126 pivots relative to the actuator link 28 and 128. Simultaneously, the control link 42 and 142 pivots the guide link 38 and 138 about the adjustment axis 39 and 139 without moving the actuator link 28 and 128 to limit movement of the element connection 20 and 120 and/or the vehicle system connection 44 and 144 during such adjustment. In other words, the position of both of the first pedal lever 14 and 114 and the second pedal lever 32 and 132 occurs simultaneously or as one adjustment whereas the normal operation of the respective levers is independent of the other. That is, during normal operation at any adjusted position, the element connection 20 and 120 is moved by pivoting the first pedal lever 14 and 114 relative to the adjustment link 22 and 122 to pivot the actuator link 28 and 128 via the drag link 26 and 126. Alternatively or independently, the vehicle system connection 44 and 144 is moved during pivotal movement of the second pedal lever 32 and 132 about the operational axis 40 and 140.

Obviously, the adjustment link 22 and 122 may be pivoted relative to the bracket 12 and 112 between a plurality of operational positions. In order to power such adjustment, a drive mechanism 46 and 146 is attached to the bracket 12 and 112 for pivoting the adjustment link 22 and 122 relative to the bracket 12 and 112 between the operational positions. In addition, the drive mechanism 46 and 146 holds the adjustment link 22 and 122 in the selected adjustment position. As illustrated, the drive mechanism 46 and 146 comprises a worm gear arrangement rotated by an electric motor 52 and 152.

The bracket 12 and 112 includes a main body or upper portion having a pair of parallel flanges for supporting the adjustment link 22 and 122. An arm 48 and 148 extends downwardly and laterally of the upper portion to a support end 50 and 150. The guide link 38 and 138 is supported at the support end 50 and 150 of the arm 48 and 148.

In the embodiment of FIGS. 1–4, the first pivot joint or axis 24 and 124 is defined by a tube extending between two parallel adjustment links 22. The tube may be rotatably supported by the adjustment links 22 and the first pedal lever 14 welded thereto, or the tube may be welded to the adjustment links 22 with the pedal lever rotatable relative thereto, as by being supported on a rod extending within the tube. In addition, the actuator link 28 is secured to a tube defining the pivot axis 29, this tube being rotatable relative to the adjustment links 22. The first embodiment also includes a third pedal lever 60. The third pedal lever 60 is pivotally attached to its adjustment link 62 via a pivot axis of tube 64. The adjustment link 62 is pivotally attached to the bracket 12 on the same axis 29 but on the opposite side of one of the flanges of the bracket 12. A drag link 66 connects the third pedal lever 60 to a control rod 67, which would be attached to the clutch mechanism of a vehicle. An actuator link (not shown) interconnects a pivot axis or tube 69 and the drag link 66. The third pedal lever mechanism operates in the same general manner as the first pedal lever mechanism.

The invention has been described in an illustrative manner, and it is to be understood that the terminology which has been used is intended to be in the nature of words of description rather than of limitation.

Obviously, many modifications and variations of the present invention are possible in light of the above teachings and the invention may be practiced otherwise than as specifically described within the scope of the appended claims, wherein that which is prior art is antecedent to the novelty set forth in the ÿcharacterized byÿ clause. The novelty is meant to be particularly and distinctly recited in the ÿcharacterized byÿ clause whereas the antecedent recitations merely set forth an old and well known combination in which the invention resides and these antecedent recitations should be interpreted to cover any combination in which the inventive novelty has utility. In addition, the reference numerals are merely for convenience and are not to be in any way to be read as limiting.

What is claimed is:

1. An adjustable pedal assembly (10 and 110) comprising;

a mounting bracket (12 and 112) for attachment to a vehicle structure, a first pedal lever (14 and 114) having an upper end (16 and 116) and a lower pad end (18 and 118), a motion transmitting element connection (20 and 12) for attachment to and moving a motion transmitting element, a linkage mechanism supporting said pedal lever for operative pivotal movement relative to said bracket (12 and 112) in an operational position and supporting said element connection (20 and 120) for movement during said operative pivotal movement and for adjustmnent of the operational position of said pad end (18 and 118) relative to said bracket (12 and 112) while limiting movement of said element connection (20 and 120) relative to said bracket (12 and 112) during said adjustment, said linkage mechanism including an adjustment link (22 and 122) pivotally supported by said bracket (12 and 112) at one end thereof and extending to a distal end, said upper end (16 and 116) of said first pedal lever (14 and 114) being pivotally attached to said distal end of said adjustment link (22 and 122) and a second pedal lever (32 and 132) having upper (34 and 134) and lower (36 and 136) ends and rotatable about an operational axis (40 and 140), said assembly (10 and 110) characterized by a control link (42 and 142) connecting said second pedal lever (32 and 132) and said adjustment link (22 and 122) for adjusting the operational position of said operational axis (40 and 140) of said pedal lever (32 and 132) in response to said adjustment of said operational position of said pad end (18 and 118) of said first pedal lever (14 and 114) relative to said bracket (12 and 112), and a guide (38 and 138) supported by said bracket (12 and 112) for guiding movement of said operational axis (40 and 140) of said second pedal lever (32 and 132) during said adjustment thereof.

2. An assembly (10 and 110) as set forth in claim 1 wherein said guide (38 and 138) comprises a guide link connected to said bracket (12 and 112) for pivotal movement about an adjustment axis (39 and 139) and pivotally supports the second pedal lever (32 and 132) for pivotal movement about an operational axis (40 and 140).

3. An assembly (10 and 110) as set forth in claim 2 wherein said upper end (34 and 134) of said second pedal lever (32 and 132) extends above said operational axis (40 and 140) and said lower end (36 and 136) of said second pedal lever (32 and 132) extends below said operational axis (40 and 140), said upper end (34 and 134) of said second pedal lever (32 and 132) including a vehicle system connection (44 and 144).

4. An assembly (10 and 110) as set forth in claim 3 including a drive mechanism (46 and 146) attached to said bracket (12 and 112) for pivoting said adjustment link (22 and 122) relative to said bracket (12 and 112) between the operational positions.

5. An assembly (10 and 110) as set forth in claim 4 wherein said drive mechanism (46 and 146) holds said adjustment link (22 and 122) in the selected adjustment position.

6. An assembly as set forth in claim 3 including a drag link (26 and 126) pivotally connected to said first pedal lever (14 and 114) for moving said element connection (20 and 120) during said operative pivotal movement of said first pedal lever (14 and 114).

7. An assembly (10 and 110) as set forth in claim 6 including an actuator link (28 and 128) pivotally attached to said bracket (12 and 112) and extending to a stabilizing end, said drag link (26 and 126) being pivotally connected at a first end to said actuator link (28 and 128), said second pedal lever (32 and 132) including a vehicle system connection (44 and 144) which has limited movement during said adjustment, said element connection (20 and 120) being disposed on said actuator link (28 and 128) whereby the position of said pad end (18 and 118) of said first pedal lever (14 and 114) may be adjusted by pivoting said adjustment link (22 and 122) relative to said bracket (12 and 112) as said drag link (26 and 126) pivots relative to said actuator link (28 and 128) and said control link (42 and 142) pivots said guide link (38 and 138) about said adjustment axis (39 and 139) to limit movement of said element connection (20 and 120) and said vehicle system connection (44 and 144) during such adjustment and for moving said element connection (20 and 120) by pivoting said first pedal lever (14 and 114) relative to said adjustment link (22 and 122) to pivot said actuator link (28 and 128) via said drag link (26 and 126) during normal operation and for independently moving said vehicle system connection (44 and 144) during pivotal movement of said second pedal lever (32 and 132) about said operational axis (40 and 140).

8. An assembly (10 and 110) as set forth in claim 7 wherein said upper end (34 and 134) of said second pedal lever (32 and 132) extends above said operational axis (40 and 140) and said lower end (36 and 136) of said second pedal lever (32 and 132) extends below said operational axis (40 and 140), said vehicle system connection (44 and 144) being disposed at said upper end of said second pedal lever (32 and 132).

9. An assembly (10 and 110) as set forth in claim 7 wherein said adjustment link (22 and 122) may be pivoted relative to said bracket (12 and 112) between a plurality of operational positions, and a drive mechanism (46 and 146) for pivoting said adjustment link (22 and 122) relative to said bracket (12 and 112) between said operational positions.

10. An assembly (10 and 110) as set forth in claim 3 wherein said control link (42 and 142) and said upper end (16 and 116) of said first pedal lever (14 and 114) are pivotally attached to said distal end of said adjustment link (22 and 122) on a common axis (24 and 124).

11. An assembly (10 and 110) as set forth in claim 2 wherein said bracket (12 and 112) includes an upper portion for supporting said adjustment link (22 and 122) and an arm (48 and 148) extending downwardly from said upper portion to a support end (50 and 150), said guide link (38 and 138) being supported at said support end (50 and 150) of said arm (48 and 148).

* * * * *